US006896206B1

(12) United States Patent
Chen

(10) Patent No.: US 6,896,206 B1
(45) Date of Patent: May 24, 2005

(54) NOZZLE STRUCTURE OF A LAWN SPRINKLER

(76) Inventor: Chin-Yuan Chen, No. 75, Liau Tsuoh Lane, Liau Tsuoh Li, Lu-Kang Chen, Chang-Hua Hsien (TW)

( * ) Notice: Subject to any disclaimer, the term of this patent is extended or adjusted under 35 U.S.C. 154(b) by 0 days.

(21) Appl. No.: 10/727,880

(22) Filed: Dec. 5, 2003

(51) Int. Cl.[7] ..... A62C 31/00
(52) U.S. Cl. ..... 239/437; 239/440; 239/394; 239/600
(58) Field of Search ..... 237/436–449, 237/525, 600, 390–396, 222.11, 222.19, 222.21, 237/222.23, 223, 231, DIG. 1; D23/214

(56) References Cited

U.S. PATENT DOCUMENTS 4,674,687 A * 6/1987 Smith et al. ..... 239/447
5,127,580 A * 7/1992 Fu-I ..... 239/447
5,415,348 A * 5/1995 Nelson ..... 239/71
6,164,566 A * 12/2000 Hui-Chen ..... 239/394

* cited by examiner

*Primary Examiner*—Dinh Q. Nguyen
(74) *Attorney, Agent, or Firm*—Alan D. Kamrath; Nikolai & Mersereau P.A.

(57) ABSTRACT

A lawn sprinkler is provided with a nozzle structure including a nozzle piece, a guide seat, and a receptacle. The nozzle piece is fastened to one end of the guide seat. The guide seat is provided at the one end with a fastening portion, a fitting portion, and a leakproof flange located between the fastening portion and the fitting portion. The guide seat is held in the receptacle in such a way that the fitting portion of the guide seat is fitted into an opening of one end of the receptacle, and that the opening of the receptacle is sealed off by the leakproof flange of the guide seat.

2 Claims, 4 Drawing Sheets

NOZZLE STRUCTURE OF A LAWN SPRINKLER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lawn sprinkler, and more particularly to a leakproof nozzle structure of the lawn sprinkler.

BACKGROUND OF THE INVENTION

As shown in FIG. 5, a sprinkler nozzle structure of the prior art comprises a nozzle piece 50, a guide seat 60, and a receptacle 70. The guide seat 60 is provided at one end with a fastening portion 61, and at the other end with a tapered portion 63. Located between the fastening portion 61 and the tapered portion 63 is a fitting portion 62. The fastening portion 61 is used to fasten the nozzle piece 50, while the tapered portion 63 is located in the receptacle 70.

Such a prior art nozzle structure as described above is defective in design in that the fitting portion 62 of the guide seat 60 is apt to fit improperly into an outer end 71 of the receptacle 70, and that the tapered portion 63 of the guide seat 60 is susceptible to dislocation, as illustrated in FIG. 6. In light of such deficiencies as described above, the prior art nozzle structure is prone to leak.

BRIEF SUMMARY OF THE INVENTION

The primary objective of the present invention is to provide a lawn sprinkler with a nozzle structure which is provided with means to prevent leak.

In keeping with the principle of the present invention, the foregoing objective of the present invention is attained by a nozzle structure comprising a nozzle piece, a guide seat, and a receptacle. The nozzle piece is provided with a plurality of water emission holes. The guide seat is provided at one end with a fastening portion for holding securely the nozzle piece, and at the other end with a tapered portion. The guide seat is further provided with a leakproof flange which is located between the fastening portion and a fitting portion of the tapered portion. The guide seat is joined with the receptacle in such a way that the tapered portion of the guide seat is snugly located in a locating portion of the interior of the receptacle, and that a front open end of the receptacle is sealed off by the leakproof flange of the guide seat.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
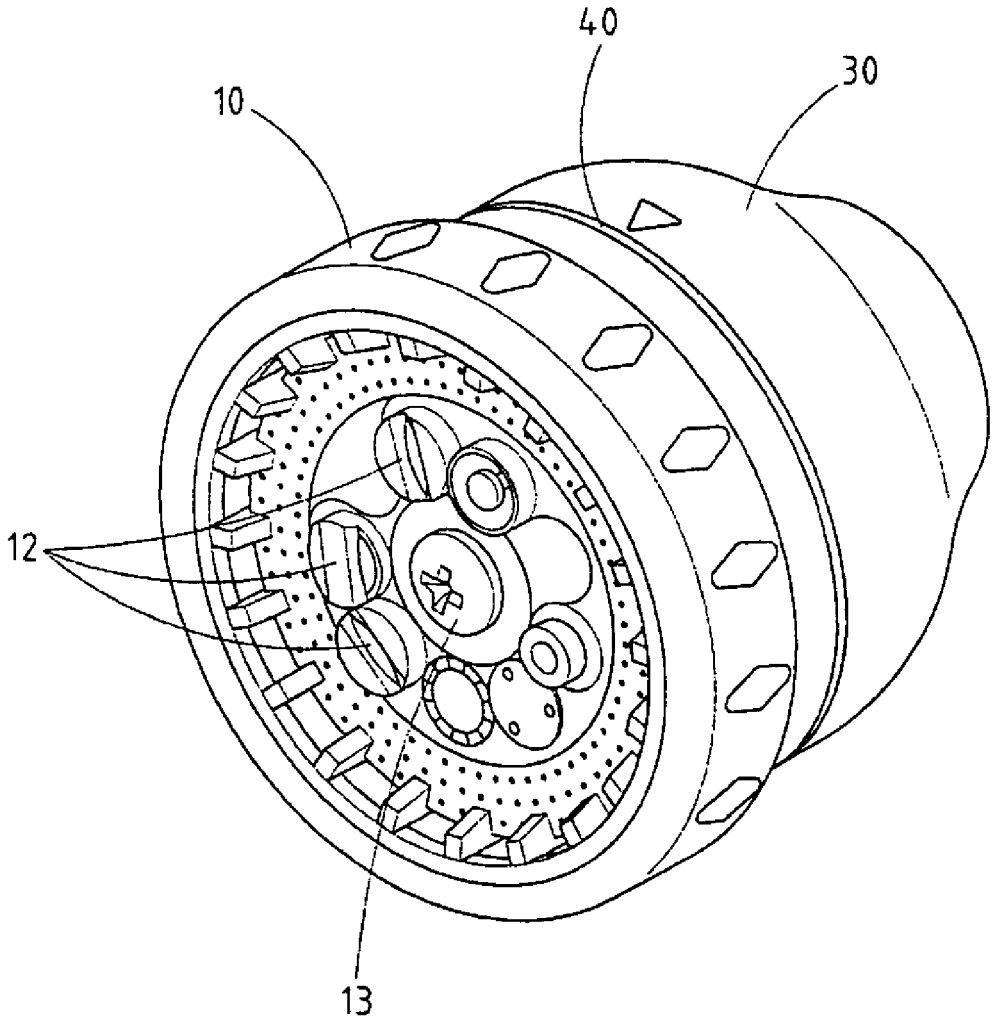
FIG. 1 shows a perspective view of the preferred embodiment of the present invention.
Figure 2:
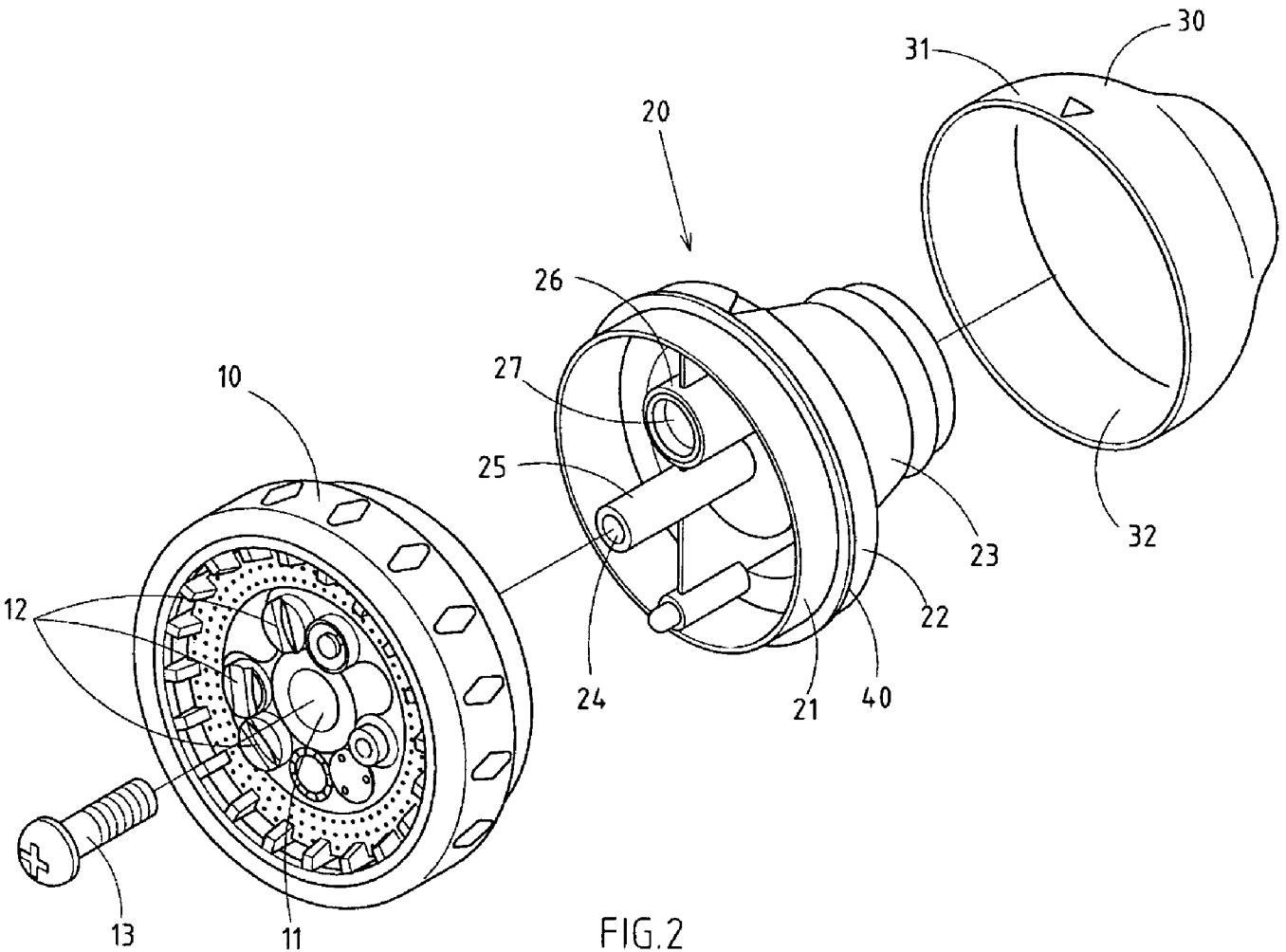
FIG. 2 shows an exploded perspective view of the preferred embodiment of the present invention.
Figure 3:
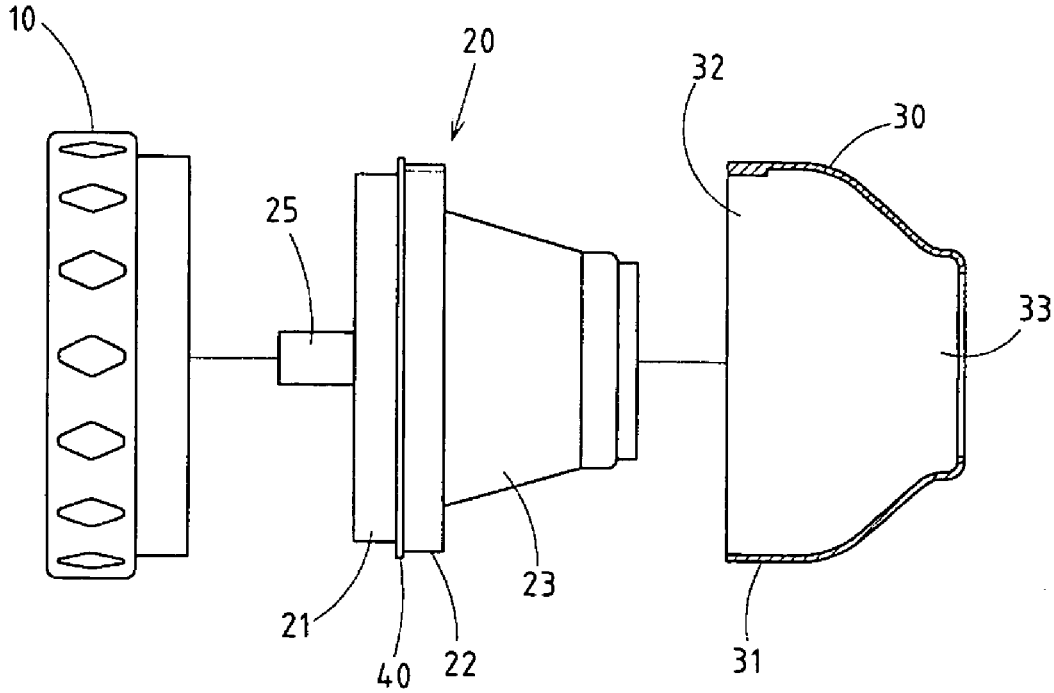
FIG. 3 shows another exploded perspective view of the preferred embodiment of the present invention.

As shown in FIGS. 1–4, a nozzle structure embodied in the present invention is used along with a lawn sprinkler (not shown in the drawings.) The nozzle structure comprises a nozzle piece 10, a guide seat 20, and a receptacle 30.

The nozzle piece 10 is provided with a center through hole 11 and a plurality of water emission holes 12.

The guide seat 20 is provided at one end with a fastening portion 21, a fitting portion 22, and a leakproof flange 40 located between the fastening portion 21 and the fitting portion 22. The guide seat 20 is further provided at the other end with a tapered portion 23, and in the interior with a fastening projection 25 and a water duct 26. The fastening projection 25 is provided with a threaded hole 24. The water duct 26 is provided with an outlet 27. The nozzle piece 10 is fastened with the guide seat 20 by a fastening bolt 13, which is engaged with the threaded hole 24 of the guide seat 20 via the center through hole 11 of the nozzle piece 10.

Figure 4:
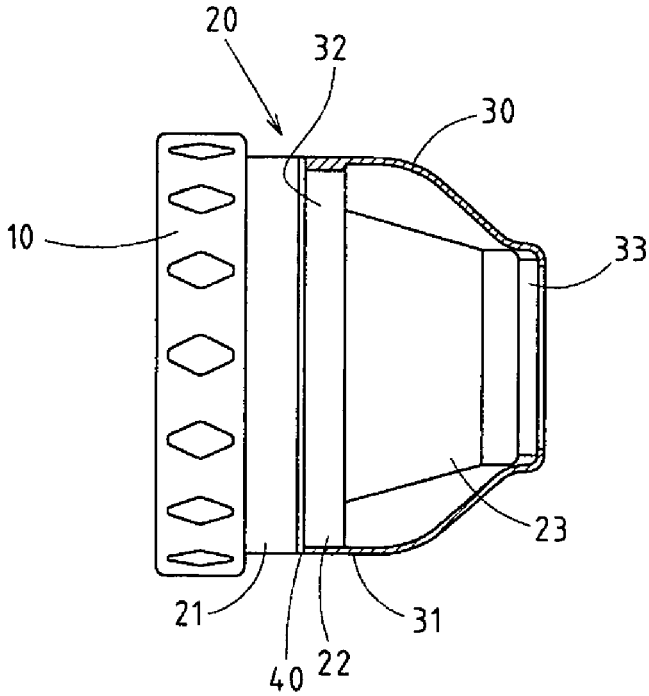
FIG. 4 shows a longitudinal sectional view of the preferred embodiment of the present invention.
Figure 5:
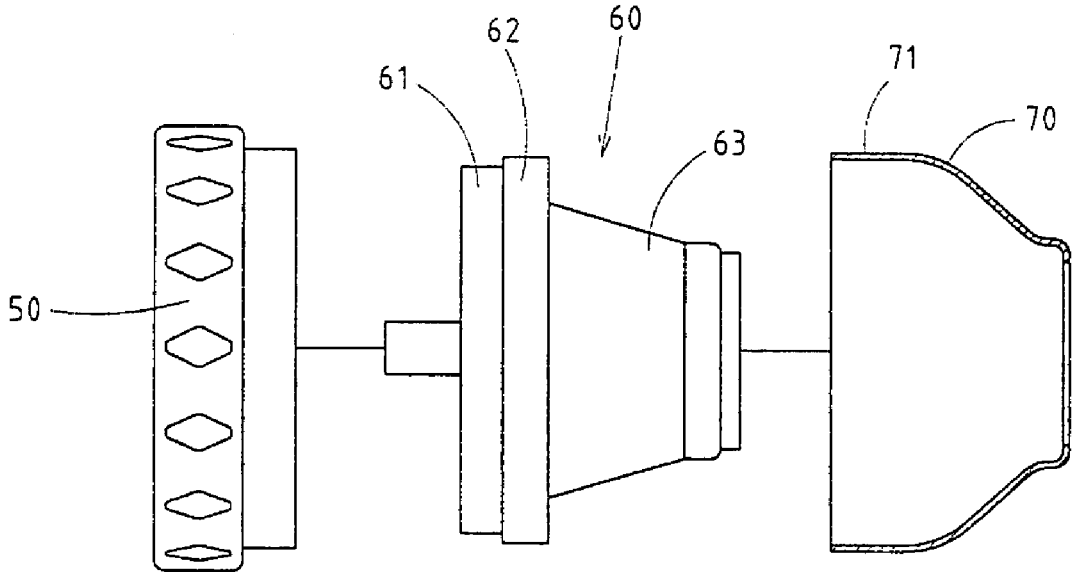
FIG.5 PRIOR ART
FIG. 5 shows an exploded perspective view of a nozzle structure of the prior art.
Figure 6:
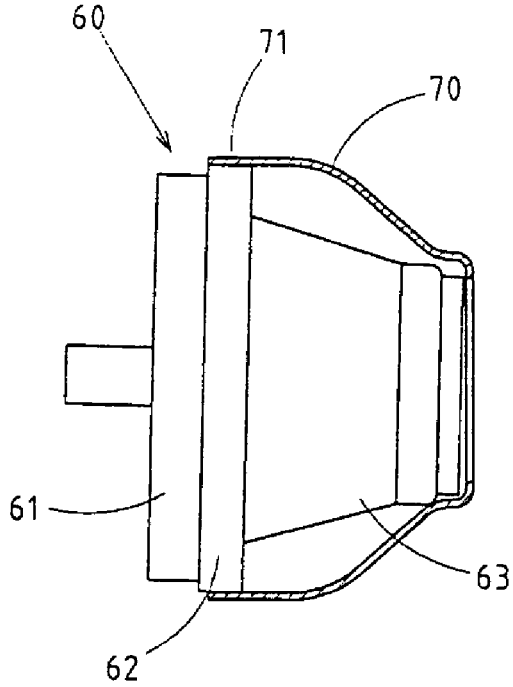
FIG.6 PRIOR ART
FIG. 6 shows a longitudinal sectional view of the nozzle structure of the prior art.

The receptacle 30 is provided at one end 31 with an opening 32, and in the interior of other end thereof with a locating portion 33. The guide seat 20 is received in the receptacle 30 in such a manner that the tapered portion 23 of the guide seat 20 is located in the locating portion 33 of the receptacle 30, and that the fitting portion 22 of the guide seat 20 is fitted securely into the opening 32 of the receptacle 30, and that the opening 32 of the receptacle 30 is sealed off by the leakproof flange 40 of the guide seat 20, as shown in FIG. 4.

The embodiment of the present invention described above is merely illustrative. Accordingly, the present invention may be embodied in other specific forms without deviating from the spirit thereof. The present invention is therefore to be limited only by the scope of the following claim.

I claim:

1. A nozzle structure of a lawn sprinkler, said nozzle structure comprising:

a nozzle piece provided with a plurality of water emission holes;

a receptacle having a first end having an inside provided with an opening and a second end having an inside provided with a locating portion; and a guide seat mounted between said nozzle piece and said receptacle and having a first end having a peripheral wall provided with a fastening portion securely mounted on said nozzle piece and a fitting portion closely fitted into said opening of said receptacle, and a second end having a peripheral wall provided with a tapered portion located by said locating portion of said receptacle;

wherein the peripheral wall of the first end of said guide seat is further provided with a leakproof flange located outside of said opening of said receptacle and enclosed around an end wall of said opening of said receptacle to closely seal said opening of said receptacle.

2. The nozzle structure as claimed in claim 1, wherein said leakproof flange of said guide seat is located between said fastening portion and said fitting portion and has an outer diameter greater than that of said fitting portion.

* * * * *